United States Patent [19]

Katoh

[11] 4,093,111

[45] June 6, 1978

[54] AUTOMATED APPARATUS FOR JOINING WOOD PLATES IN SIDE-BY-SIDE RELATION

[75] Inventor: Sadahiko Katoh, Ikeda, Japan

[73] Assignee: Suntory Ltd., Osaka, Japan

[21] Appl. No.: 757,152

[22] Filed: Jan. 6, 1977

Related U.S. Application Data

[63] Continuation-in-part of Ser. No. 557,117, Mar. 10, 1975, abandoned.

[30] Foreign Application Priority Data

July 4, 1974 Japan ..... 49-76715

[51] Int. Cl.[2] ..... B27F 7/02

[52] U.S. Cl. ..... 227/26; 227/40; 227/45

[58] Field of Search ..... 227/14, 26, 28, 29, 227/30, 40, 44, 45

[56] References Cited

U.S. PATENT DOCUMENTS

| | | | |
|---|---|---|---|
| 705,657 | 7/1902 | Edwards et al. | 227/26 |
| 1,080,274 | 12/1913 | Frantz | 227/14 |
| 1,137,854 | 5/1915 | Frantz | 227/14 |
| 1,780,721 | 11/1930 | Scheidemandel | 227/26 |

*Primary Examiner*—Granville Y. Custer, Jr.
*Attorney, Agent, or Firm*—Flynn & Frishauf

[57] ABSTRACT

An automated apparatus for joining a set of a plurality of wood plates in a side-by-side relation to form, for instance, a heading for a barrel, comprises a nail driving means for driving a different given number of nails in different positions into a wood plate, depending on the position the wooden plate assumes relative to an intended end plate, the nail driving means including in combination a hopper, sliding plate and nail guide means having slits and channels, respectively. Further provided is a sealing material feeding means for inserting an elongated sealing material between the adjoining wooden plates before being joined, which sealing material feeding means includes chucks permitting movement along the length of the body of the apparatus and pivotal movement perpendicular to the length of the body of the apparatus, thus releasing tension or other forces which would be introduced to the sealing material when the adjoining wooden plates are joined with the sealing material interposed therebetween, thereby preventing the elongated sealing material from breaking during the joining operation.

16 Claims, 28 Drawing Figures

AUTOMATED APPARATUS FOR JOINING WOOD PLATES IN SIDE-BY-SIDE RELATION

CROSS REFERENCE TO RELATED APPLICATION

This is a Continuation-In-Part of U.S. Application Ser. No. 557,117, filed Mar. 10, 1975, now abandoned.

BACKGROUND OF THE INVENTION

1. Field of the Invention

This invention relates to an apparatus for joining wooden plates in a side-by-side relation, and more particularly to an apparatus capable of automatically joining a plurality of wooden plates having varying lengths and widths to produce a heading for a barrel.

2. Description of the Prior Art

A method is known in which a plurality of wooden plates are joined in parallel abutting relation to produce a flat wide plate. However, the known method involves complicated manual operations. This is particularly true in the case where sealing materials are to be inserted between the adjoining wooden plates. Such manual operations necessarily lead to excessive manpower requirements and thus are of a time-consuming nature.

Particularly, when the widths as well as the lengths of the wooden plates vary, such difficulties are further increased, even accompanying some danger in such manual operations. More particularly, when manufacturing a heading for use in a barrel, the number and positions of nails to be driven into the adjoining wooden plates should be varied depending on the position of the adjoining wooden plates relative to the intended end plate. This further complicates the aforesaid manual operations with accompanying workmanship errors.

In addition, when elongated sealing members, such as cattails, are to be inserted between the wooden plates before they are joined, such sealing members are apt to be tensioned when nails are driven, so that there sometimes takes place premature rupture or breakage of a sealing member, producing a defective joint. Time-consuming operations result for reassembling or repair of such defective joints.

Accordingly, it has been long desired to automate the operations in joining plates side-by-side and to solve various problems experienced with the prior art wooden plate joining operations.

It is accordingly a principal object of the present invention to provide an automated apparatus for joining a plurality of wooden plates in a side-by-side relation, despite the varying lengths and widths of the wooden plates.

It is another object of the present invention to provide an automated apparatus for joining wooden plates in a side-by-side relation, in which the number and positions of nails to be driven into the adjoining wooden plates are automatically determined under a given program.

It is a further object of the present invention to provide an automated apparatus for joining wooden plates in side-by-side relation, in which a sealing member is automatically inserted between the adjoining wooden plates before joining, without any constrained tension being induced therein, upon joining.

SUMMARY OF THE INVENTION

According to the present invention, there is provided an automated apparatus for joining a plurality of wooden plates in a side-by-side relation, comprising conveyor means for conveying a plurality of wooden plates to a given position; means for receiving thereon said plurality of wooden plates one-by-one; nail driving means adapted to reciprocate over a given distance in the longitudinal direction of the body of the apparatus; a pair of sealing material feeding means adapted to slidingly move upwards and downwards as well as permitting the transverse pivotal movement of chucks relative to the longitudinal direction of the body of the apparatus; platen means on which the adjoining wooden plates are joined in side-by-side relation; a hold-down plate positioned above said platen means and adapted to move upwards and downwards; wooden plate holding means adapted to move back and forth in the longitudinal direction of the body of the apparatus and cooperative with the nail driving means; and means for forcing the wooden plates, thus joined in the transverse direction, off of the platen means to clear the wooden plates from the platen means.

According to another aspect of the present invention, the aforesaid nail driving means of an automated apparatus for joining a plurality of wooden plates in a side-by-side relation, comprises, from above downwards, a hopper, in which a plurality of nails are placed in order, i.e., the directions of the respective nails being aligned in a given direction; a sliding plate having a plurality of slits which are adapted to admit nails therethrough and spacing the nails given varying distances; nail guide means adapted to be placed ahead of but in contact with said nail driving means and having nail guide channels which are adapted to be brought into registration with a first number of specific slits of said plurality of slits for receiving nails passing therethrough in a first position of said nail driving means, said channels being further adapted to be brought into registration with a second number of specific slits of said plurality of slits for receiving nails passing therethrough in a second position thereof; and a plurality of upright nail-direction aligning members which are mounted on said hopper. The nail-direction aligning members are over the channels. One or more of the slits may be common to the first and second number of slits.

According to a further aspect of the present invention, a sealing material feeding means for an apparatus for joining adjoining wooden plates in a side-by-side relation comprises a pair of chucks disposed spaced apart in the transverse direction of the body of the apparatus; and a pair of arms mounting said chucks thereon and pivoted to a means coupled to a piston of an actuating cylinder; said arms being spring loaded so as to permit pivotal movements thereof in the longitudinal direction of the body of the apparatus, thereby accommodating tension forces which would be imparted to the sealing material when the wooden plates are actually joined, said piston being adapted to move upwards and downwards.

DESCRIPTION OF THE PREFERRED EMBODIMENTS

Figure 27:
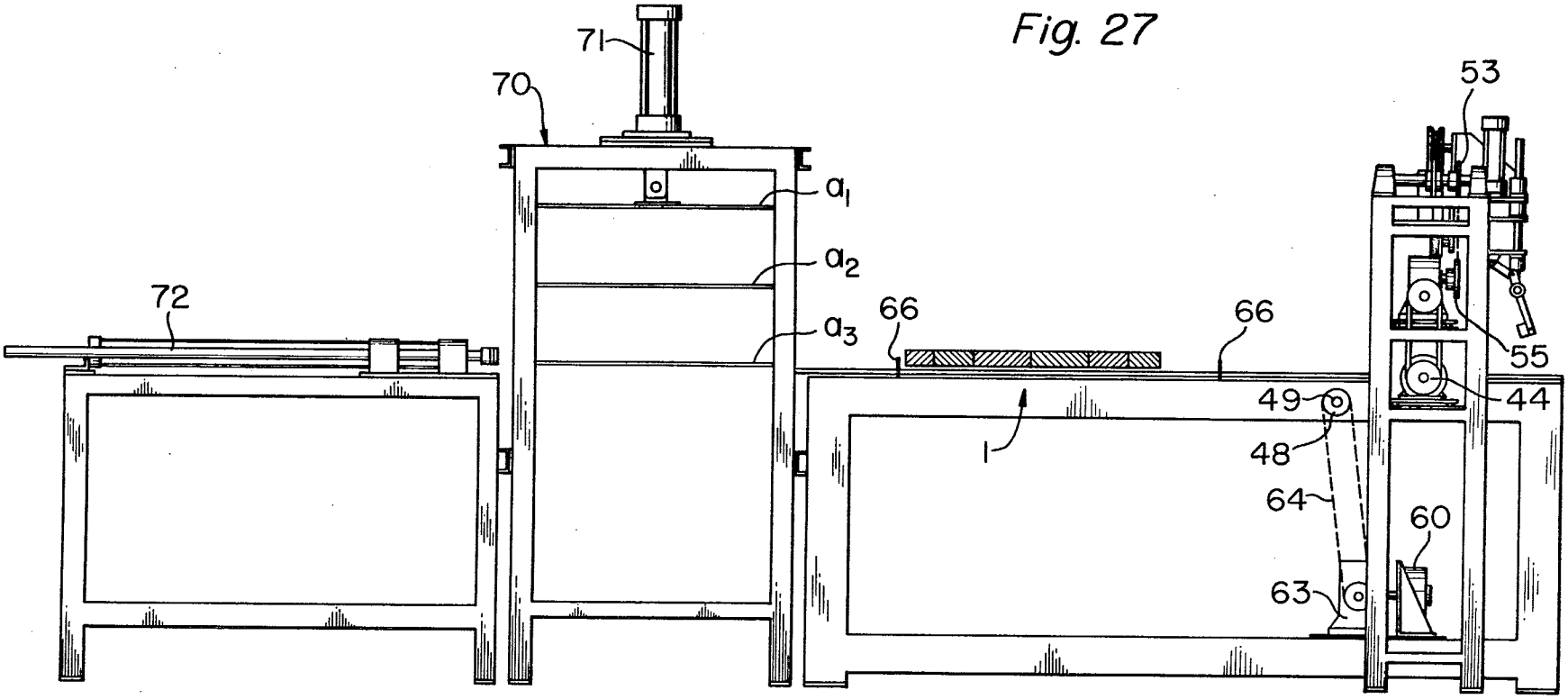
FIG. 27 is a side view of the complete apparatus.

Referring now to FIGS. 1 and 5–9 and 27, a conveyor means 1 is provided which is adapted to transport a set of a plurality of wooden plates. A plurality of sets of wooden plates are assembled and stored in a multi-level device 70 (FIG. 27). The shelves $a_2$ and $a_3$ are raised and lowered as a set by means of a cylinder 71 connected to cross member $a_1$ to cause successive shelves $a_2$ and $a_3$ to be in alignment with the platform of conveyor 1. The sets of plates are pushed out of the aligned shelf ($a_3$ in FIG. 27) by a cylinder 72. After the pushing cylinder 72 operates, the motor 60 (FIG. 5) is operated to move the plates via chains 61, 62 (FIG. 1) and pusher elements 65, 66 which are secured to the chains 61, 62. The motor 60 drives endless chains 61, 62 (FIG. 1) for transporting wooden plates via a reduction gear 63, drive chain 64 and pulley and axle 48, 49, respectively. The set of wooden plates are thus automatically transported, as a set, on the conveyor 1 from the assembly and storage device 70 (FIG. 27) and are caused to stop at another conveying means 2 by means of a photoelectric switch. The photoelectric switch includes a light source 19 and a receiver 122 (shown in FIG. 6). The receiver 122 is connected to the drive motor 60 of the conveyor 1 to stop the conveying when the foremost wooden plate is detected to be in the proper position for pick-up by the next conveying means.

Figure 1:
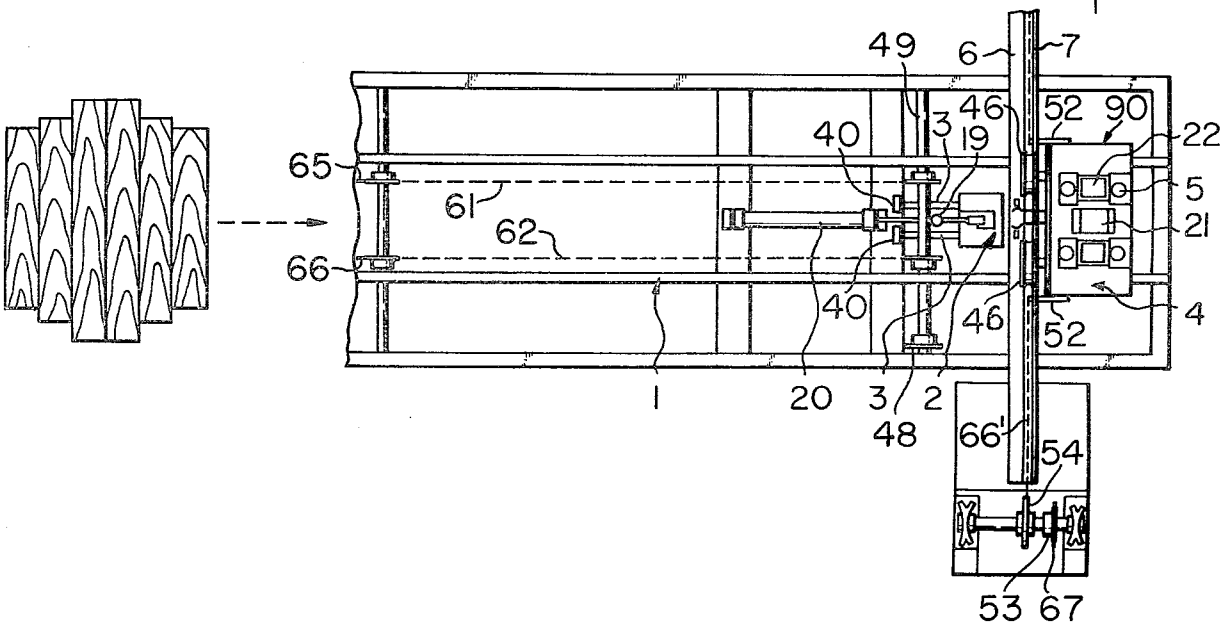
FIG. 1 is a plan view of a conveyor means which is part of the automated apparatus for joining wooden plates in a side-by-side relation, according to the present invention.
Figure 10:
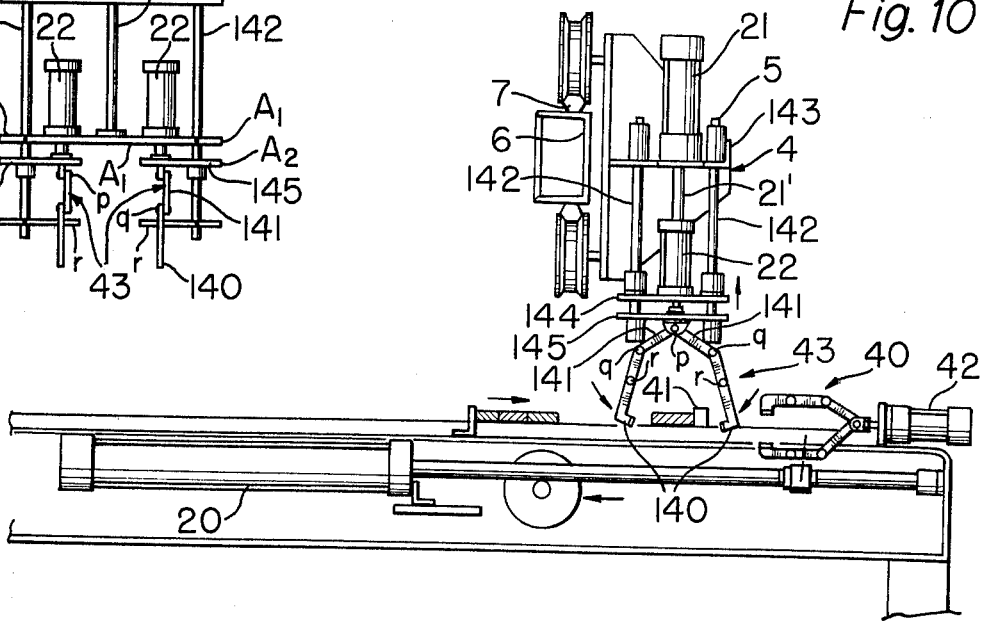
FIGS. 10 and 11 show details of the conveying means and the gripping device.
Figure 11:
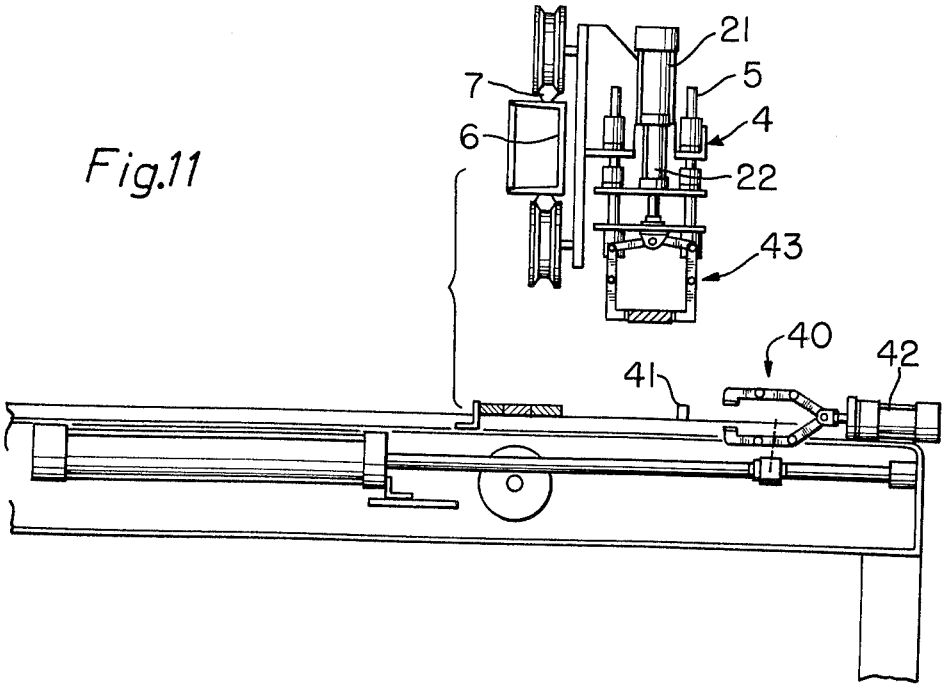
Figure 12:
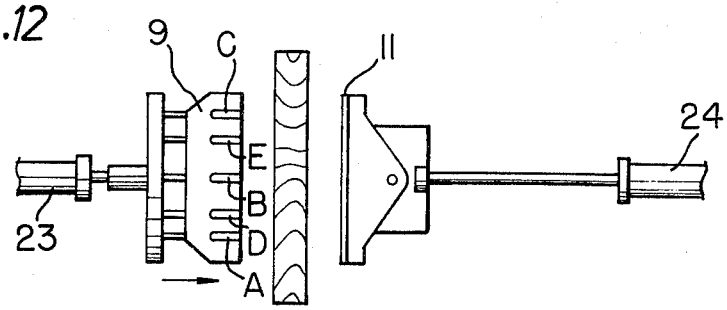
FIGS. 12–19 show details of the wooden plate holding means and the sequential operation thereof.

When the wooden plates are stopped by means of the photoelectric switch, the conveying means 2 is actuated, after which chucks 40, carried by the conveying means 2, are caused to grip the wooden plates one-by-one, each of which is then transported to a given stop position against a stop member 41 (see FIGS. 6–9) and then released thereat. FIGS. 6–9 show the operating sequence of chucks 40 to move a plate to the stop member 41. Cylinder 42 operates the opening and closing of the chucks 40. Thereupon, the chucks 40 move backwards by means of cylinder 20 a distance corresponding to its stroke, as shown in FIGS. 10 and 11. The connection of the chucks 40 to conveying means 2 and to the cylinder 20 is shown in FIG. 6. As seen in FIG. 1, two identical chuck assemblies 40 are provided which are operated together. Only one chuck and assembly 40 is shown in FIGS. 5–11. The wooden plate which has been left at the aforesaid given stop position (i.e., at 41) is then transported to the subsequent station. At this time, the chucks 40 are moved back to their initial position ready to start the aforesaid cycle over again to grip the second wooden plate. When the first wooden plate is transported to the aforesaid given stop position, as seen in FIG. 10, a cylinder 21 of the conveying means 4 is operated to lower chucks 43 and then the first wooden plate is gripped by chucks 43, FIGS. 10 and 11, after which the cylinder 21 is operated to raise the gripped first wooden plate.

The wooden plate is then transported on to a receiving support 8 (FIGS. 1, 2 and 6) by means of a drive arrangement including girder 6, rails 7, carriage 90, chains 66; the aid of an electric motor 44 and reduction gearing 45. This drive system is discussed in detail later.

Figure 28:
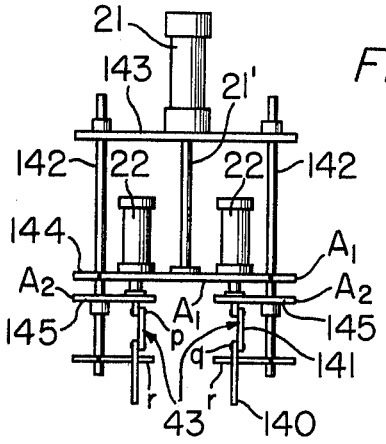
FIG. 28 is a side view of the chucks shown in FIG. 10.

As shown in FIG. 28, two chucks 43 are provided, only one set of chucks being shown in FIG. 10. Each set of chucks includes lower links 140 and upper links 141 pivoted together at pivot points *q*. Lower links 140 are pivotal about fixed pivot points *r* which are fixed to fixed rods 142. The cylinder 21 is mounted on a fixed plate 143 and its rod 21′ is connected to a plate 144 on which cylinders 22 are mounted. The rods of cylinders 22 are connected to lower members 145 to which the upper links 141 are pivotally connected. As pivot points *p* are lowered by operation of cylinders 22, the positions of pivot points *r* do not vary and the chucks 43 close on a wooden plate member as shown in FIG. 11. The distance of pivot point *r* to the plate 144 is kept constant by means of rods 142. In FIGS. 10 and 11, various parts (shown in FIG. 28) were omitted for clarity of illustration.

Figure 5:
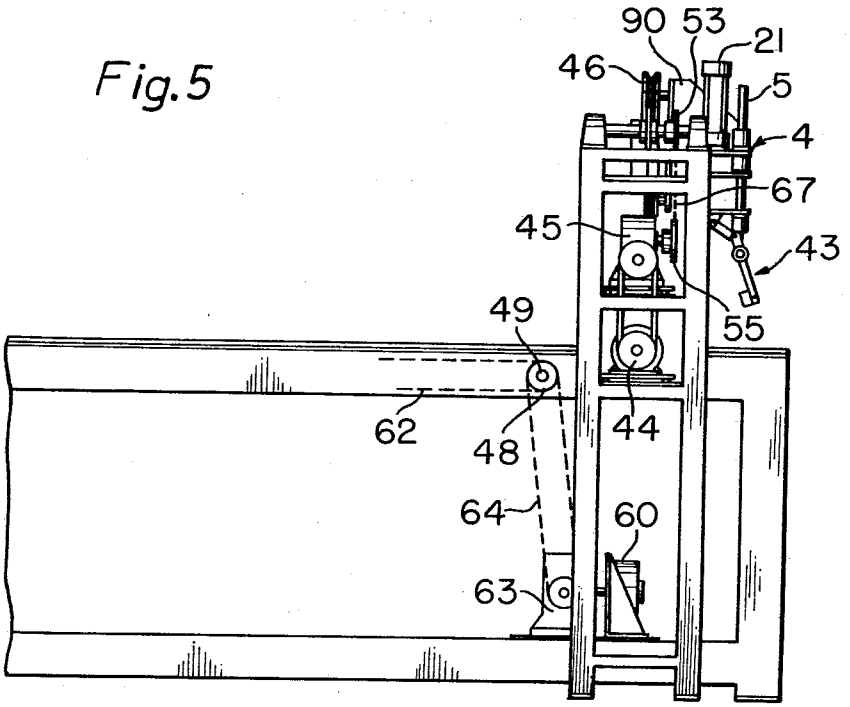
FIG. 5 is a side view of FIG. 1.
Figure 6:
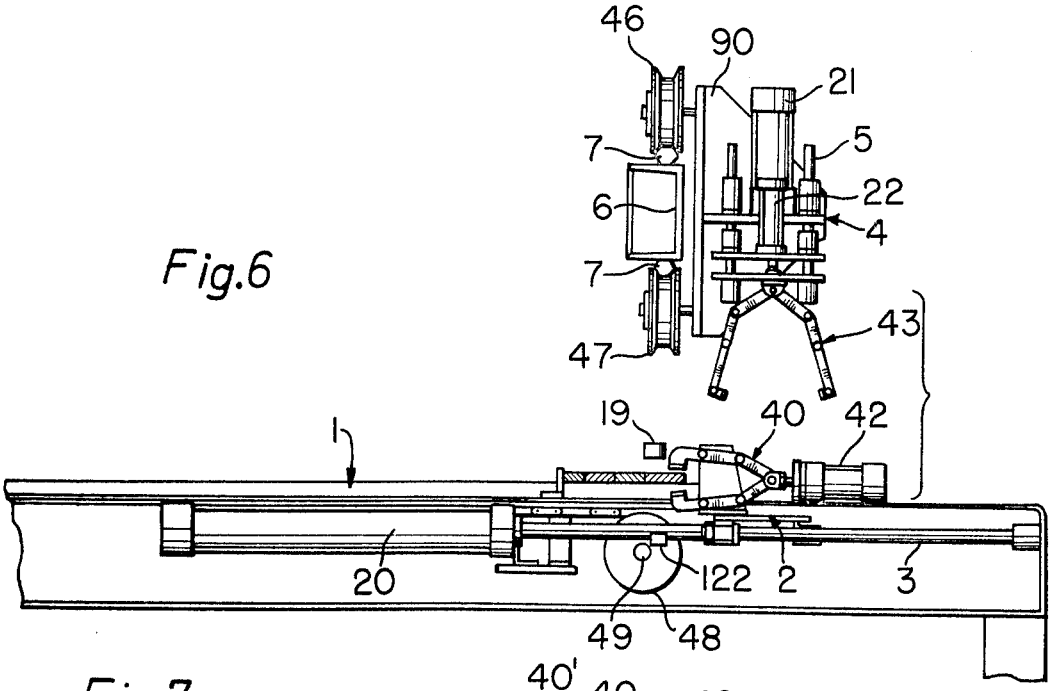
FIGS. 6–9 show details of the operation of separating wooden plates one-by-one.

As shown in FIGS. 1, 5 and 6, a motor 44 drives the carriage 90 (which carries chucks 43) through the reduction gear 45 and chains 66, 67. Endless chain 67 passes over driven gear wheel 55 and drives gear wheel 53. Wheel 54 on the same shaft as wheel 53 is then driven to move chain 66′ which is secured to carriage 90 at attachment members 52 (FIG. 1). Motor 44 is reversible to drive the carriage 90 in either direction along rails 7. Pairs of idler wheels 46 and 47 are rotatably secured to the carriage 90 of conveying means 4. The idler wheels 46, 47 engage rails 7 and due to the propeling force produced by chain 66′ (shown in FIG. 1) enable the conveying means 4 to move smoothly along rail 7 in the direction of arrow A (FIGS. 1 and 2) to a receiving support 8 shown in FIG. 2. The upper part of the rail 7 and girder 6 in FIG. 1 join the lower parts of the corresponding members in FIG. 2.

Figure 2:
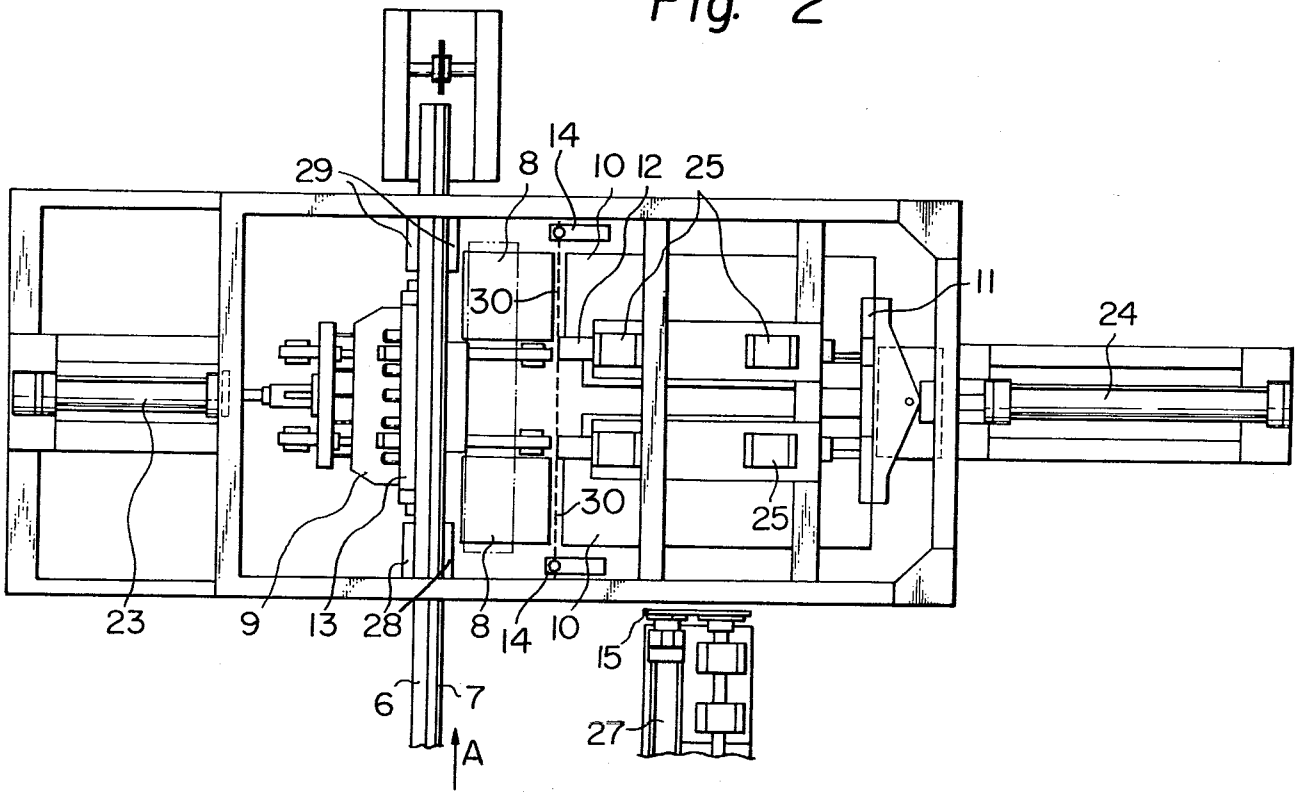
FIG. 2 is a plan view of the essential part of the apparatus for joining wooden plates in a side-by-side relation according to the present invention.
Figure 3:
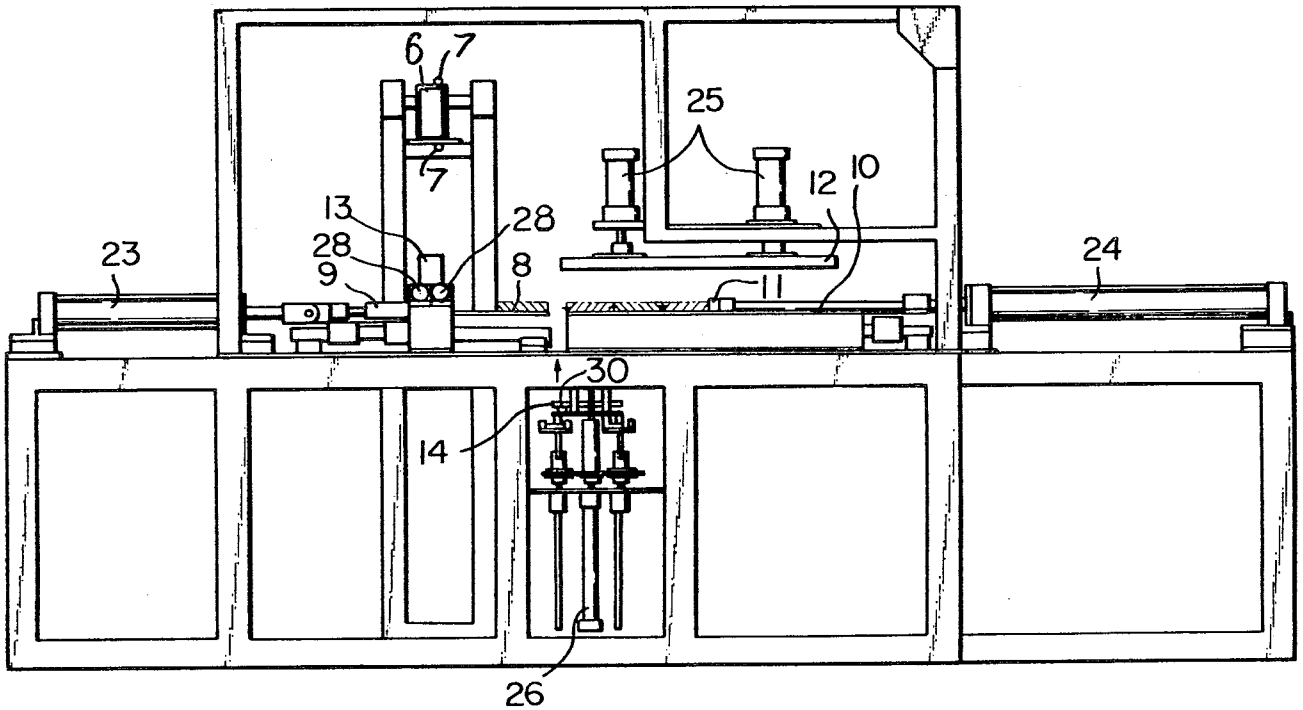
FIG. 3 is a side view of the aforesaid essential part of the apparatus shown in FIG. 2, with some of the joined wooden plates being shown.

Referring to FIGS. 2 and 3, before the first wooden plate arrives at the receiving support 8, a nail driving means 9 has remained in its retracted position, while a wooden plate holding means 11 positioned on a platen 10 is moved to its full extent towards the receiving support 8 by means of a hydraulic cylinder 24, with the hydraulic circuit being maintained closed. A hold-down frame 12, shown in its raised position in FIGS. 2 and 3, is also lowered by means of a cylinder 25 to its lower position. In FIG. 3, the carriage 90 is not shown so as not to unduly complicate the drawings. The carriage 90 could be considered to be in the position shown in FIG. 1. Referring again to the first wooden plate placed on the receiving support 8, the nail driving means 9 moves forwards (i.e., to the right in FIG. 2) due to the actuation of cylinder 23 to thereby urge the first wooden plate against wooden plate holding means 11, whereupon the nail driving means is actuated to start to drive a given number of nails which have been set in given positions. Until the nail driving operation has been completed, the hydraulic circuit for the hydraulic cylinder 24 is maintained closed. Upon completion of the nail driving operation, the hydraulic circuit of cylinder 24 is released so that the wooden plate holding means 11 is pushed back a given distance together with the first wooden plate under the influence of pressurized cylinder 23 and then stops. The holding means 11 and the wooden plate are pushed back said driven distance after the nail driving operation by the cylinder 23 extending to its full stroke position. When cylinder 23 is fully extended, the hydraulic circuit for cylinder 24 is closed again, ready for cylinder 24 to again be actuated maintaining a stand-by condition. The nail driving means 9 is now retracted to its home position.

Figure 15:
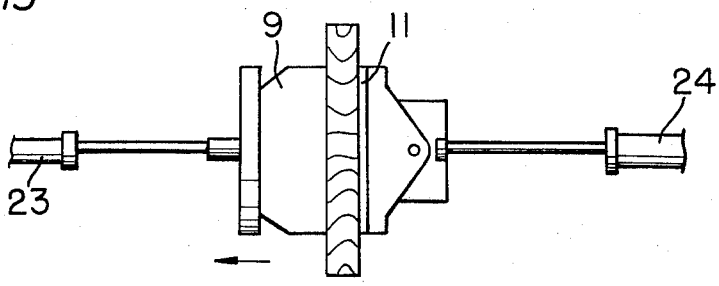
Figure 16:
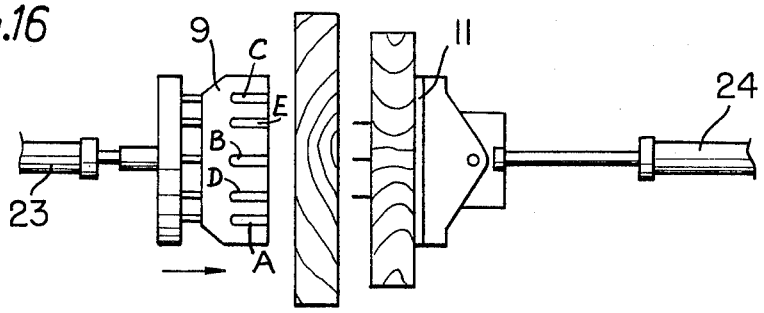
Figure 19:
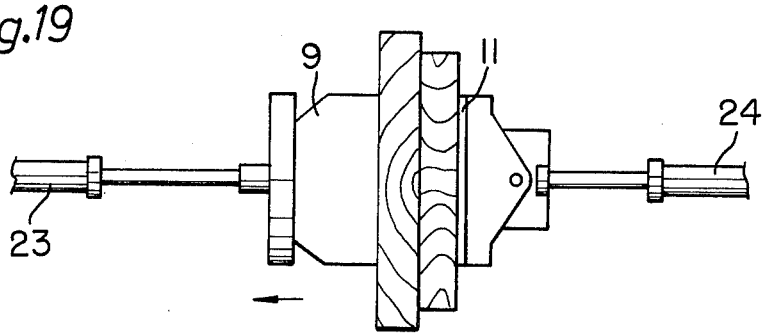

FIG. 12 to FIG. 19 show details of the wooden plate holding means 11 and the operation thereof. Before the nail driving operation (FIG. 12, FIG. 13, FIG. 16 and FIG. 17), holding means 11 is fixedly maintained in a given position by closing the hydraulic circuit of cylinder 24. Upon completion of the nail driving operation (FIG. 14 and FIG. 18), the hydraulic circuit of cylinder 24 is released immediately. Then the nail driving means 9 is advanced further by the action of hydraulic cylinder 23 extending to its full stroke, and at the same time the wooden plate(s) with the holding means 11 are pushed back in the right hand direction as shown in the drawing. When nail driving means 9 is stopped after an advance for the full stroke of cylinder 23 (constant in the nail driving operations), the hydraulic circuit of cylinder 24 is closed and holding means 11 is fixed in position with the wooden plate(s) (FIG. 15 and FIG. 19). Thereafter, nail driving means 9 is moved back to its home position. In the nail driving operation, when a nail is driven into a plate in the first instance, it is driven in about ⅓ of its length. When a next wooden plate is joined to a plate previously having nails driven therein, the nails penetrate into each adjoining plate so that the nails are about ½ penetrated into each plate. FIGS. 12–15 show the nail driving operation of the first wooden plate and FIGS. 16–19 show the joining operation of the second wooden plate with the first wooden plate (omitting the inserting of a sealing material).

The aforesaid cycles of operations are repeated for the second wooden plate to join the second wooden plate to the first wooden plate in a side-by-side relation. In this respect, in the above-described case of the first wooden plate, there is no wooden plate to which the first wooden plate is joined, so that there is no need to insert a sealing material between the plates. For this reason, sealing material feeding means 14 (FIG. 3) is maintained in its non-operating condition by means of an instruction fed from the conveying means 1 which indicates that the first wooden plate is being operated on.

Figure 20:
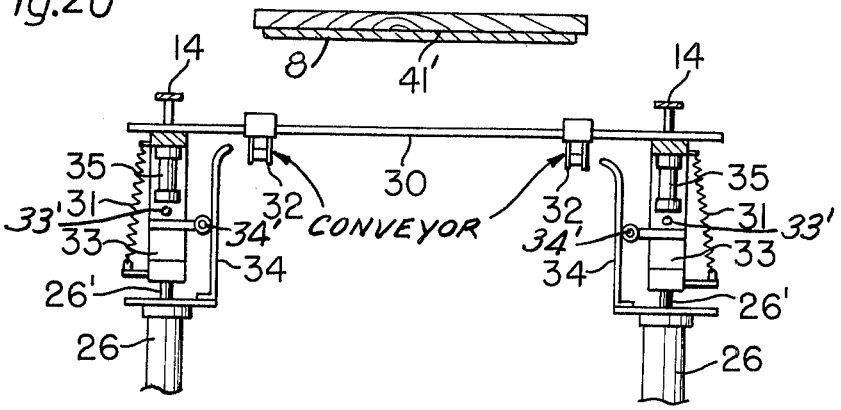
FIGS. 20 and 21 are cross-sectional views showing details of the chucks and lift cylinder device therefor.
Figure 21:
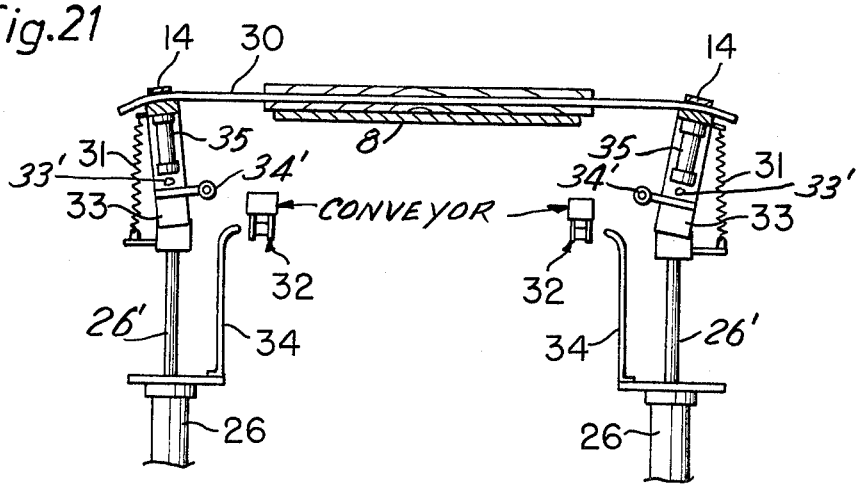
Figure 22:
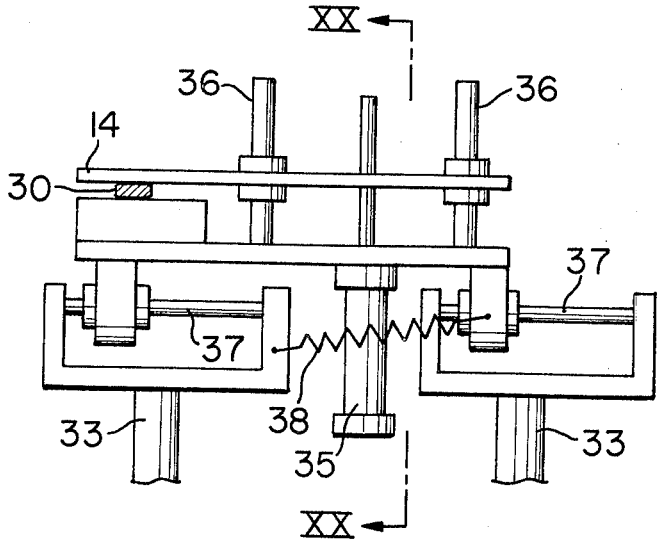
FIG. 22 shows still further details of the chuck and cylinder devices of FIGS. 20 and 21.

Referring now to FIGS. 2, 3 and 20–22, upon completion of the nail driving operation for the first wooden plate, the elongated sealing material (i.e., cattails) which has been transported one-by-one on a conveyor 32 is gripped on its opposite sides by means of a pair of spaced apart chucks 14 which are positioned outwardly of the sides of the receiving support 8 and joining platen 10. The conveyor 32 is only partly shown for simplicity of illustration and description. As seen in FIGS. 20–22, the chucks 14 are mounted on respective arms 33 which in turn are pivotally attached at pivot points 33' to respective pistons 26' fitted in cylinders 26, while being loaded by springs 31 so as to be biased outwardly in the longitudinal direction of the elongated sealing material 30. The sealing material 30 is caused to ascend into the joint position, i.e., behind the projecting tips of nails which have been about ⅓ driven into the first wooden plate by raising the piston rods 26' by operating the cylinders 26, and is then stopped in this raised position as seen in FIG. 21. When nails are driven into the second wooden plate, the elongated sealing material 30 is forced against the tips of nails to admit same and is held between the first and second wooden plates. In this respect, as has been generally described above and as shown in FIG. 22, the chucks 14 may, under the influence of plate joining forces exerted thereon by the plates and/or nails, move in the longitudinal direction of the body of the apparatus (i.e., in the direction of nailing) by sliding on axes 37, thus eliminating constrained tension, wrinkling or breaking of the sealing material 30 which otherwise would have been caused. Upon completion of the insertion of the sealing material 30, the chucks 14 move back to their home positions by operating cylinders 26 to lower rods 26'. The above operations are described in greater detail below.

FIG. 20 and FIG. 21 are a transverse cross-sectional view of the essential parts of chucks 14 and a lift cylinder device 26 in two respective operational conditions. In FIGS. 20 and 21, several components shown in FIG. 22 are omitted for ease of illustration. FIG. 20 shows the device just before the gripping of the sealing material 30 by chucks 14. Springs 31 bias the chucks 14 outwardly in the longitudinal direction of the sealing material. The wooden plate(s) 41' is at its operational position on the support 8 as illustrated in FIGS. 20 and 21. FIG. 21 shows the position when the chucks 14, which are gripping sealing material 30, have reached the "joint" position. As shown in FIG. 20, the springs 31 impart tension to sealing material 30 and act to prevent bending or sagging of sealing material 30 which is transported by the conveying means 32 one-by-one, in accordance with the ascendance of the arms 33 by the action of lift cylinder devices 26, namely, in accordance with the engagement of roller devices 34' with a fixed plate cam 34.

Figure 23:
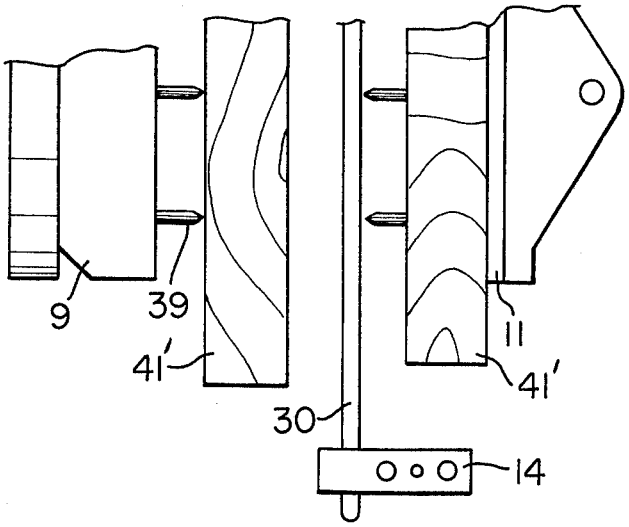
FIG. 23 shows details of a nail driving operation.

FIG. 22 shows the details of chucks 14 and cylinder devices 26 of FIGS. 3, 20 and 21. A cylinder 35 lowers and raises chucks 14 and correspondingly acts to fix or release chucks 14. Fixed rods 36 are provided on which chucks 14 slide upward or downward for gripping or releasing sealing material 30. As shown in FIG. 23, during a nail driving operation, sealing material 30 is forced in a direction of the operation under the influence of a plate and/or the nails, and sealing material 30 is put under tension. When sealing material 30 receives tension, chuck 14 slides on an axis 37 (FIG. 22) to release tension responsive to the force of the tension of sealing material 30 itself. After completion of the nail driving operation, chuck 14 is caused to release sealing material 30. When chuck 14 releases material 30, chuck 14 is pulled back to the home position by the action of spring 38, and then chuck 14 is lowered to the original lower position by the action of cylinder 26.

In the above-described manner, nails are driven continuously and automatically. The driving of nails for the last wooden plate is interrupted by means of a signal fed from the conveying means indicating that the last wooden plate is being conveyed, which means that only sealing material is fed between a wooden plate and the last wooden plate. This is because the next-to-last plate already has nails protruding therefrom. When a set of wooden plates have been joined together, the hold-down plate 12 is moved upwards, after which a pushing-out means 15 (FIG. 2) is actuated to thereby clear a set of joined wooden plates from the joining platen 10. The pushing-out means 15 is actuated by a cylinder 27 to push the jointed plates out transversely of the apparatus.

It should be noted, however, that as far as the widths of the wooden plates fall in the range of one stroke of the nail driving means 9, the widths of the wooden plate are of no consequence, nor are the lengths thereof.

A description will now be given in more detail of the nail driving phase of the joining operation. In the case of the manufacture of a heading of a barrel, the opposite end portions of the first and last wooden plates are to be cut off, so that nails have to be driven into the central portions thereof rather than the end portions thereof. Thus, the positions of nails to be driven should vary depending upon the positions wooden plates assume in the final heading.

Figure 4:
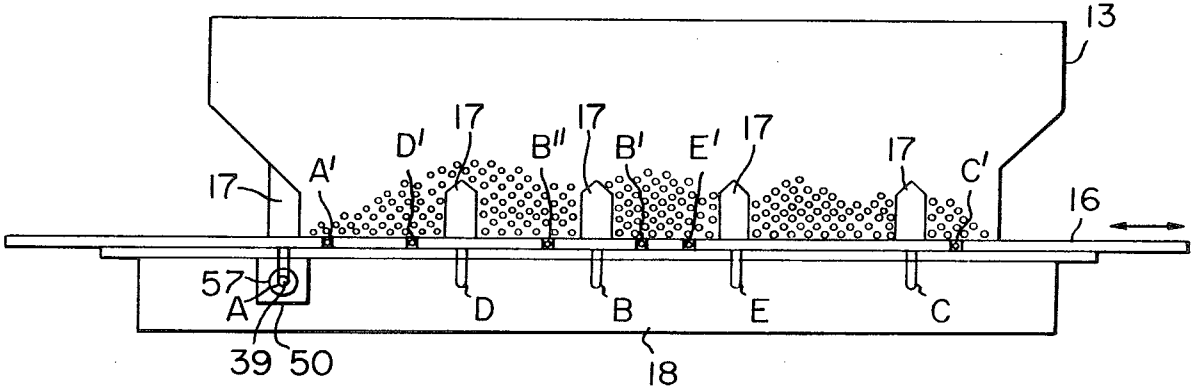
FIG. 4 is a transverse cross-sectional view of a hopper when mounted ahead of a nail driving means, with respect to the longitudinal direction of the essential part of the apparatus shown in FIGS. 2 and 3.

Turning to FIG. 4, there is shown a hopper 13, in which a plurality of nails are placed. In this respect, the hopper 4 is shown in its cross-section transverse to the longitudinal direction of the body of the apparatus, so that the tips of nails are shown as spots or circles. Placed under but in contact with the hopper 13 is a sliding plate 16 which is slidable in the directions of the doubleheaded arrow shown in FIG. 4. Fixedly mounted on the hopper 13 are a plurality of upright nail-direction aligning members 17. The sliding plate 16 has nail slits A′, D′, B″, B′, E′, C′ therethrough, while a guide means 18 has channels A, D, B, E, C (shown in detail in FIGS. 24–26) therein. The upright naildirection aligning members 17 are positioned right above the channels in the guide member 18 in the position shown to cause the nails to drop into the channels A, D, B, E, C in the proper alignment. In the initial stage, nails enter slits A′-E′ of sliding plate 16, which slits are out of registration with channels A-E of guide member 18. For driving nails into the first wooden plate, the sliding plate 16 is moved by means of an air cylinder to the right as viewed in FIG. 4 of the drawing so as to bring the slits in registration with channels, i.e., D′ with D, B″ with B, and E′ with E. Thus, nails 39 enter only in the channels D, B, E, as shown in FIG. 4, rather than A and C, because the nails 39 have to be driven at a closer spacing for the first wooden plate. For the second and third wooden plates, the sliding plate 16 is moved to the left as viewed in FIG. 4 of the drawing, thus bringing in registration A′ with A, B′ with B, and C′ with C, maintaining the channels D and E free of nails. When nails are placed in the channels as described above, then the sliding plate 16 is returned to its home position, i.e., as shown in FIG. 4, thus allowing nails to enter slits A′-E′. FIG. 3 shows air cylinders 28, 29 for respectively moving sliding plate 16 in the respective opposite directions. A similar procedure as in the case of the first wooden plate is repeated for the second or third last wooden plate for the same reason as has been described earlier. For the last wooden plate, the sliding plate 16 is moved to the home position shown in FIG. 4, thereby feeding no nails into channels A-C. Each nail channel A-E is defined by a respective housing member 50 with a nail guiding member 57 mounted therein.

Figure 13:
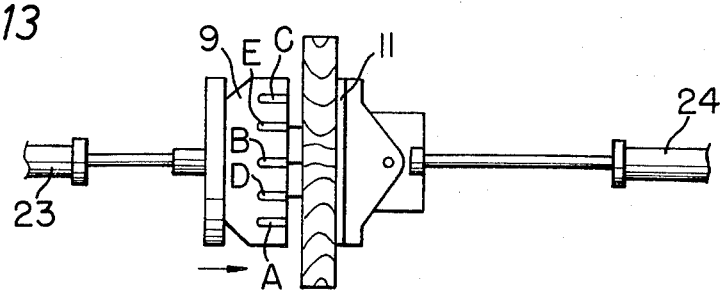
Figure 14:
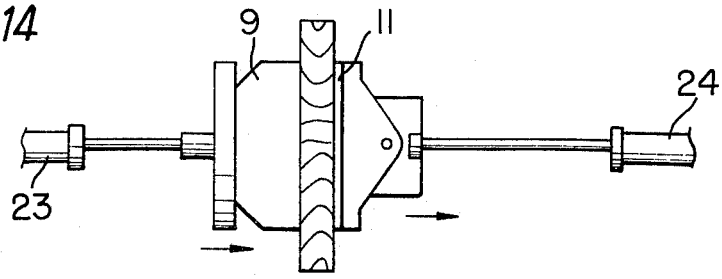
Figure 17:
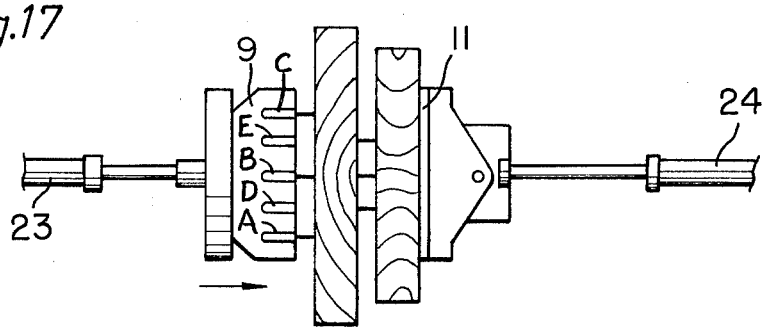
Figure 18:
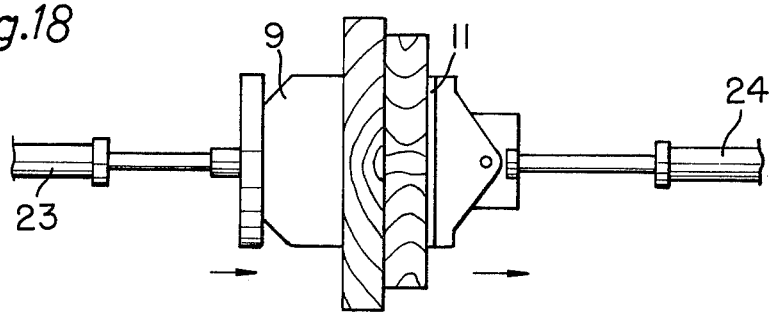
Figure 24:
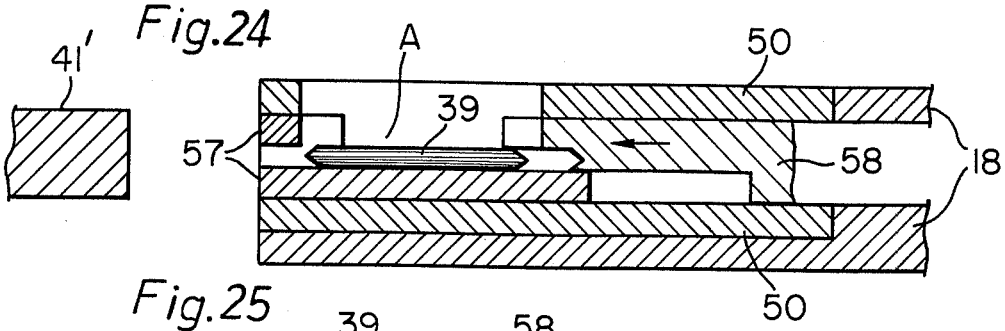
FIGS. 24–26 are side views of a nail driving device in various respective operational positions.
Figure 25:
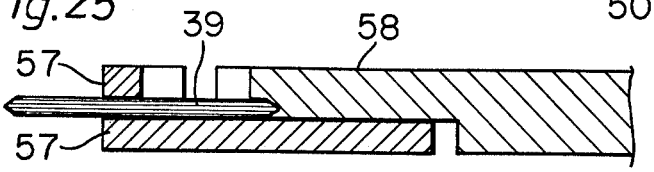
Figure 26:
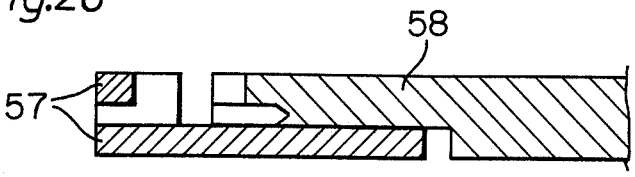

FIGS. 24–26 are side views illustrating essential parts of the nail driving mechanism. Nails 39 are driven by a plunger 58 of the nail driving means 9. FIG. 26 shows the nail driving mechanism having no nails, namely, in the last nail driving operation of joining the last of a set of wooden plates. As shown in FIG. 13, on the first nail driving operation, nails are placed only in the channels D, B and E by the action of the sliding plate 16 in FIG. 4; namely no nails are placed in the channels A and C. In FIGS. 12, 13, 16 and 17 the channels A-E are shown schematically. In practice they are as shown in FIGS. 4 and 24–26. Therefore, on the first nail driving operation, the nails are driven at closer spacing, namely, in "the first position". As shown in FIG. 17, on the second nail driving operation, the nails are placed only in the channels A, B and C. Therefore, the nails are driven at a broad spacing, namely, in "the second position". In FIGS. 24–26, the direction of the nail driving operation is shown opposite to that shown in FIG. 12 and in the other figures.

Figure 7:
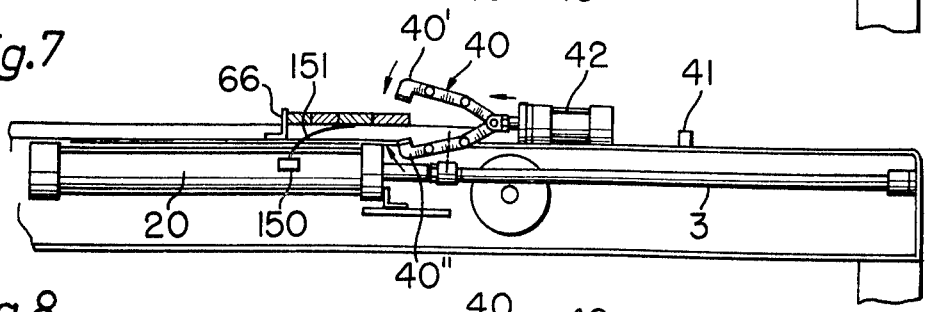
Figure 8:
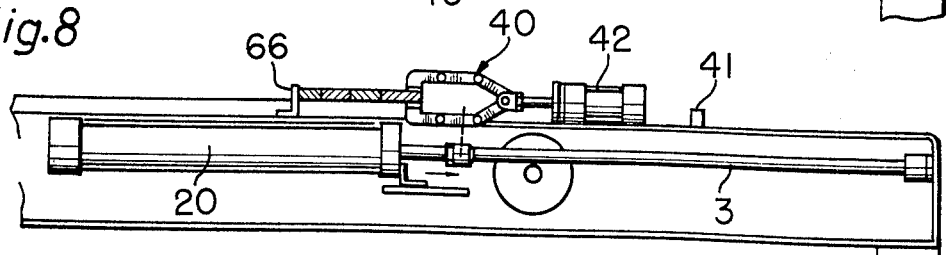
Figure 9:
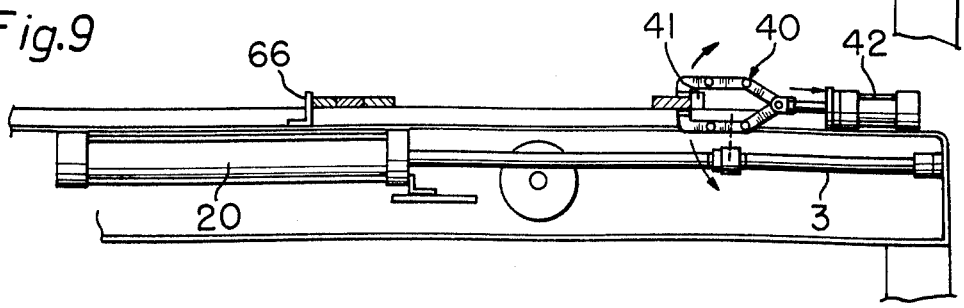

During the first nail driving operation, as described hereinabove, nails are driven at a closer spacing and no sealing material is inserted. This first nail driving operation may be detected by actuation of a switch by an operator, or may be automatically actuated by means of a limit switch which detects the first wooden plate fed to the nail driving means. After completion of the first nail driving operation, the system is automatically switched over to a mode of operation to provide broad spacing of the nails and to insert sealing material between adjacent wooden plates. A limit switch 150, for example as shown in FIG. 7, is provided on the conveying means 1 to detect the last wooden plate being operated on. When the last wooden plate is removed by means of chucks 40, the actuating member 151 of limit switch 150 will stand up, or will otherwise sense the absence of the wooden plate, and will send a signal to switch the nail driving means over to the mode wherein the spacing of the nails become closer. At the time when the limit switch 150 detects the last wooden plate, the next-to-last wooden plate is being transported and is located at about the middle position of rails 7, and the second-to-last plate has already been joined to the previous plates. Therefore, when the next-to-last plate is placed on the receiving support 8, the nail driving means has already been set to the mode so as to provide closer spacing of the nails. After this operation, the last driving operation is carried out with no nails, but with the sealing material being inserted between the last and next-to-last plate. This is because nails are already projecting from the next-to-last plate, which projecting nails will penetrate the last plate when it is driven thereagainst.

OPERATION

The cylinder 72 (FIG. 27) is operated in order to force out a set of arranged wooden plates from one of the shelves, for example shelf a3, to the position shown in FIG. 27. The operation of the cylinder 72 may be initiated, for example, by actuation of a manually operated switch. The motor 60 of the conveyor means is then caused to operate and is stopped by means of a photoelectric switch when the plates reach the conveying means 2. The chucks of the conveying means 2 are operated to bring the wooden plates, one-by-one, to a position under the carriage 90 which runs on the rails 7 which are mounted to a girder 6. The chucks of the carriage 90 grip the plates and the motor for driving the carriage is actuated so as to bring the plates to the receiving support 8 whereat the nail driving operation is carried out. Various timer switches are provided so as to maintain the proper sequence of events. For example, a timer is provided to insure that cylinder 20 is operated after actuation of cylinder 42.

When the wooden plates reach the receiving support 8, the nail driving operation and the insertion of the sealing material between adjacent wooden plates is carried out as described hereinabove with reference to FIGS. 12-26. Again, various timer switches are provided, for example to keep cylinder 24 closed during the nail driving operation, and in order to delete the actuation of cylinder 35 during the actuation of cylinder 26 for a short period of time in order to avoid gripping tension on the sealing material by chucks 14. Additionally, various limit switches are provided to sense that the wooden plates reach various operational areas and to operate various motors and/or cylinders.

At the start of the operations, the positions of the elements 20-29, 42 and 35 are as follows:

Cylinder 20 is in its "back" to leftmost position as seen in FIG. 1;

Cylinder 42 is "back" to open chucks 40 (FIGS. 6 and 7);

Cylinder 21 is "back" to raise cylinder 22 and chucks 43;

Cylinder 22 is "back" to keep chucks 43 open (FIG. 6);

Cylinder 23 is "back" to the left direction of FIG. 2;

Cylinder 24 is "forward" to its full extent to the left direction of FIG. 2;

Cylinders 25 are "back" to keep holding plate 12 raised; cylinders 25 are moved "forward" to lower holding plate 12 prior to a nail driving operation;

Cylinders 26 are "back" to lower sealing material holding chucks 14 (FIG. 20);

Cylinders 35 are "forward" to open chucks 14 (FIG. 20);

Cylinder 27 is "back" to the position shown in FIG. 2; and

Cylinders 28 and 29 locate sliding plate 16 in a neutral position (FIG. 4).

It should be clear that for the first plate, cylinders 26 are not actuated since sealing material is not inserted when the nails are driven into the first plate. For the last plate, cylinders 28 and 29 do not act so that the sliding plate 16 of the nail driver remains in its neutral position, for example as shown in FIG. 4. This is because new nails are not driven when the last plate is operated on.

As is apparent from the foregoing description, in the automated apparatus according to the present invention, the shifting of a set of wooden plates, feeding of a sealing material, driving of nails into each wooden plate, removal of the joined wooden plates are all carried out automatically by means of a combination of hydraulic cylinders, stoppers, photoelectric cells and/or tubes, and limit switches. Thus, before starting with such a joining operation, it is only required for an operator to place a set of wooden plates in sequence for processing. This clearly saves manpower to a great extent and eliminates time-consuming operations which have been described earlier with respect to the prior art. Thus, the apparatus according to the present invention is particularly adapted for use in joining wooden plates to form a heading of a barrel.

I claim:

1. In an automated apparatus for joining a set of a plurality of wooden plates with adjoining surfaces in a side-by-side relation, including:

conveyor means for transporting said wooden plates in sequence to a given position;

joining means at said given position for receiving thereon said plurality of wooden plates thus transported one-by-one by said conveyor means, said joining means including:

nail driving means including a nail driver which is reciprocable over a given distance in a direction substantially perpendicular to the surfaces of said wooden plates which are to be joined; platen means, on which adjacent wooden plates are supported in substantially parallel abutting relation;

a hold-down plate positioned above said platen means and being movable upwards and downwards relative to said platen means to hold said wooden plates fast or release same;

wooden plate holding means which is movable back and forth in a direction substantially perpendicular to the surfaces of said wooden plates which are to be joined to hold and retain at least one wooden plate in a fixed position when said nail driving means is operated to drive nails into said wooden plates; and means for removing joined wooden plates from said platen means after operation of said nail driving means to clear said wooden plates from said platen means;

the improvement wherein said nail driving means comprises:

a hopper containing a plurality of nails which are aligned substantially in a given direction, said hopper having a bottom opening for passing said nails out of said hopper;

a sliding plate having a given number of slits which are adapted to admit nails therethrough and spaced given distances apart, said sliding plate being disposed under but in contact with said bottom opening of said hopper and slidably movable relative to said hopper between at least a first position and a second position;

nail guide means located below said sliding plate, between the platen means and said nail driver means, said nail guide means having nail guide channels therein, a first plurality of said nail guide channels being brought in registration with a first given number of said slits of said sliding plate for receiving nails in said first plurality of channels thereof which are in registration with said first given number of slits when said sliding plate is in said first position, and a second plurality of nail guide channels being brought into registration with a second given number of said slits of said sliding plate for receiving nails in said second plurality of channels thereof when said sliding plate is in said second position, said nail driver driving the nails in said channels into a wooden plate to be joined; and a plurality of upright nail-direction aligning members mounted in said hopper in the positions over said channels for maintaining said nails in alignment.

2. A nail driving means as set forth in claim 1, wherein at least one of said nail guide channels is common to said first and second plurality of nail guide channels.

3. In an automated apparatus for joining a set of a plurality of wooden plates with adjoining surfaces in a side-by-side relation, including:

conveyor means for transporting said wooden plates in sequence to a given position;

joining means at said given position for receiving thereon said plurality of wooden plates thus transported one-by-one by said conveyor means, said joining means including:

nail driving means including a nail driver which is reciprocable over a given distance in a direction substantially perpendicular to the surfaces of said wooden plates which are to be joined;

a pair of sealing-material feeding means which are movable upwards and downwards relative to said wooden plates and which are further movable in a direction substantially parallel to the surfaces of said wooden plates which are to be joined;

platen means, on which adjacent wooden plates are supported in substantially parallel abutting relation;

a hold-down plate positioned above said platen means and being movable upwards and downwards relative to said platen means to hold said wooden plates fast or release same;

wooden plate holding means which is movable back and forth in a direction substantially perpendicular to the surfaces of said wooden plates which are to be joined to hold and retain at least one wooden plate in a fixed position when said nail driving means is operated to join said wooden plates; and means for removing joined wooden plates from said platen means after operation of said nail driving means to clear said wooden plates from said platen means;

the improvement wherein said pair of sealing-material feeding means comprises:

a pair of chucks for carrying sealing material, said chucks being disposed at opposite sides of the apparatus and opposing each other along a line substantially parallel to the surfaces of said wooden plates which are to be joined;

a pair of arms, each having one of said chucks mounted thereon, each arm being movably mounted on said opposite sides of the apparatus and being movable in a direction substantially perpendicular to the surfaces of said wooden plates which are to be joined;

a piston and actuating cylinder means coupled to said chucks for raising and lowering said chucks into and out of registration with said surfaces of said wooden plates to be joined to interpose sealing material between said joining surfaces of two wooden plates which are to be joined by said nailing means before nailing together said two plates; and spring means coupled to said arms for biasing said arms so as to permit resilient movement of said arms in said direction substantially perpendicular to the surfaces of said wooden plates which are to be joined.

4. Apparatus for joining a set of a plurality of wooden plates with adjoining surfaces in a side-by-side relation, comprising:

joining means including a platen for receiving thereon at least two wooden plates to be joined at substantially parallel surfaces thereof;

nail driving means at said joining means and including a nail driver which is reciprocable over a given distance in a direction substantially perpendicular to the surfaces of said wooden plates which are to be joined;

means for holding down a wooden plate at said platen during joining of a pair of wooden plates;

said nail driving means including:

a hopper containing a plurality of nails which are aligned substantially in a given direction, said hopper having a bottom opening for passing said nails out of said hopper;

a sliding plate having a given number of slits which are adapted to admit nails therethrough and spaced given distances apart, said sliding plate being disposed under but in contact with said bottom opening of said hopper and slidably movable relative to said hopper between at least a first position and a second position; and nail guide means located below said sliding plate, between the platen and said nail driver means, said nail guide means having nail guide channels therein, a first plurality of said nail guide channels being brought in registration with a first given number of said slits of said sliding plate for receiving nails in said first plurality of channels thereof which are in registration with said first given number of slits when said sliding plate is in said first position, and a second plurality of nail guide channels being brought into registration with a second given number of said slits of said sliding plate for receiving nails in said second plurality of channels thereof when said sliding plate is in said second position, said nail driver driving the nails in said channels into a wooden plate to be joined.

5. Apparatus according to claim 4 wherein said hopper further includes a plurality of upright nail-direction aligning members mounted in said hopper in the positions over said channels for maintaining said nails in alignment.

6. Apparatus according to claim 5, wherein at least one of said nail guide channels is common to said first and second plurality of nail guide channels.

7. Apparatus according to claim 8 wherein said arms are pivotally mounted on said opposite sides of the apparatus.

8. Apparatus for joining a set of a plurality of wooden plates with adjoining surfaces in a side-by-side relation, comprising:

joining means including a platen for receiving thereon at least two wooden plates to be joined at substantially parallel surfaces thereof;

nail driving means at said joining means and including a nail driver which is reciprocable over a given distance in a direction substantially perpendicular to the surfaces of said wooden plates which are to be joined;

a pair of sealing-material feeding means which are movable upwards and downwards relative to said wooden plates and which are further movable in a direction substantially parallel to the surfaces of said wooden plates which are to be joined; and means for holding down a wooden plate at said platen during joining of a pair of wooden plates;

said sealing-material feeding means including;

a pair of chucks for carrying sealing material, said chucks being disposed spaced apart at the apparatus and opposing each other along a line substantially parallel to the surfaces of said wooden plates which are to be joined;

a pair of arms, each having one of said chucks mounted thereon, said arms being movably mounted on said opposite sides of the apparatus and being movable in a direction substantially perpendicular to the surfaces of said wooden plates which are to be joined;

a piston and actuating cylinder means coupled to said chucks for raising and lowering said chucks into and out of registration with said surfaces of said wooden plates to be joined to interpose sealing material between said joining surfaces of two wooden plates which are to be joined by said nailing means before nailing together said two plates; and spring means biasing said arms so as to permit resilient movement of said arms in said direction substantially perpendicular to the surfaces of said wooden plates which are to be joined.

9. Apparatus according to claim 8 wherein said sealing-material is an elongated strip of sealing material which is engaged by said chucks, said spring means biasing said arms so as to retain said elongated strip of sealing-material in a taut condition.

10. Apparatus according to claim 9 wherein said piston and actuating cylinder means raises said chucks into registration with said surfaces of said wooden plates to be joined with the sealing material interposed between a surface of the wooden plates which are to be joined, said nail driving means piercing said sealing material by nails during a nail driving operation.

11. Apparatus according to claim 8 wherein said arms are further movably mounted on said opposite sides of the apparatus and being movable in a direction substantially parallel to the surfaces of said wooden plates which are to be joined, and further comprising additional spring means coupled to said arms for biasing said arms so as to also permit resilient movement of said arms in said direction substantially parallel to the surfaces of said wooden plates which are to be joined.

12. Apparatus according to claim 11 wherein said arms are pivotally mounted on said opposite sides of the apparatus.

13. In an automated apparatus for joining a set of a plurality of wooden plates with adjoining surfaces in a side-by-side relation, including:

conveyor means for transporting said wooden plates in sequence to a given position;

joining means at said given position for receiving thereon said plurality of wooden plates thus transported one-by-one by said conveyor means, said joining means including:

nail driving means including a nail driver which is reciprocable over a given instance in a direction substantially perpendicular to the surfaces of said wooden plates which are to be joined;

a pair of sealing-material feeding means which are movable upwards and downwards relative to said wooden plates and which are further movable in a direction substantially parallel to the surfaces of said wooden plates which are to be joined;

platen means, on which adjacent wooden plates are supported in substantially parallel abutting relation;

a hold-down plate positioned above said platen means and being movable upwards and downwards relative to said platen means to hold said wooden plates fast or release same;

wooden plate holding means which is movable back and forth in a direction substantially perpendicular to the surfaces of said wooden plates which are to be joined to hold and retain at least one wooden plate in a fixed position when said nail driving means is operated to join said wooden plates; and means for removing joined wooden plates from said platen means after operation of said nail driving means to clear said wooden plates from said platen means;

the improvement wherein said pair of sealing-material feeding means comprises:

a pair of chucks for carrying sealing material, said chucks being disposed at opposite sides of the apparatus and opposing each other along a line substantially parallel to the surfaces of said wooden plates which are to be joined;

a pair of arms, each having one of said chucks mounted thereon, each arm being movably mounted on said opposite sides of the apparatus and being movable in a direction substantially parallel to the surfaces of said wooden plates which are to be joined;

a piston and actuating cylinder means coupled to said chucks for raising and lowering said chucks into and out of registration with said surfaces of said wooden plates to be joined to interpose sealing material between said joining surfaces of two wooden plates which are to be joined by said nailing means before nailing together said two plates; and spring means biasing said arms so as to permit resilient movement of said arms in said direction substantially parallel to the surfaces of said wooden plates which are to be joined, thereby creating a force to pull on said sealing material to stretch same when the adjoining wooden plates are joined with said sealing material interposed therebetween.

14. Apparatus according to claim 13 wherein said arms are further slidably mounted to permit movement in a direction substantially perpendicular to the surfaces of said wooden plates which are to be joined, and further comprising additional spring means coupled to said arms for biasing said arms so as to also permit resilient movement of said arms in said direction substantially perpendicular to the surfaces of said wooden plates which are to be joined.

15. Apparatus according to claim 14 wherein said arms are pivotally mounted on said opposite sides of the apparatus.

16. Apparatus according to claim 13 wherein said arms are pivotally mounted on said opposite sides of the apparatus.

* * * * *